US006553576B1

(12) United States Patent
Knapp

(10) Patent No.: US 6,553,576 B1
(45) Date of Patent: Apr. 29, 2003

(54) GRIPPING GLOVE

(76) Inventor: Debra Knapp, 10824 Wood Ridge La., Fishers, IN (US) 46038

( * ) Notice: Subject to any disclaimer, the term of this patent is extended or adjusted under 35 U.S.C. 154(b) by 0 days.

(21) Appl. No.: 10/007,504

(22) Filed: Nov. 5, 2001

(51) Int. Cl.[7] ..... A41D 19/00
(52) U.S. Cl. ..... 2/161.6; 2/160; 2/163
(58) Field of Search ..... 2/16, 20, 160, 2/161.6, 163, 161.2–161.5; 294/25; 482/44, 47–49

(56) References Cited

U.S. PATENT DOCUMENTS

| | | | | | |
|---|---|---|---|---|---|
| 2,516,241 | A | * | 7/1950 | Mulheran | 2/160 |
| 4,522,197 | A | | 6/1985 | Hasegawa | |
| 4,796,306 | A | | 1/1989 | Mitchell | |
| 4,858,246 | A | * | 8/1989 | Wiggins | 473/205 |
| 5,018,221 | A | * | 5/1991 | Romandetto | 2/16 |
| D320,871 | S | | 10/1991 | Bothof, III et al. | |
| 5,070,862 | A | | 12/1991 | Berlant | |
| D348,090 | S | | 6/1994 | Riley, Jr. | |
| 5,335,373 | A | | 8/1994 | Dangman et al. | |
| 5,357,636 | A | | 10/1994 | Dresdner, Jr. et al. | |
| 5,369,807 | A | | 12/1994 | Cho et al. | |
| 5,435,013 | A | * | 7/1995 | Davis | 2/161.1 |
| 5,688,208 | A | | 11/1997 | Plemmons | |
| 5,768,711 | A | * | 6/1998 | Wissink | 2/161.1 |
| 5,898,944 | A | * | 5/1999 | Vrany | 2/161.4 |

* cited by examiner

*Primary Examiner*—John J. Calvert
*Assistant Examiner*—Katherine Moran
(74) *Attorney, Agent, or Firm*—Liell & McNeil

(57) ABSTRACT

A gripping glove comprises a glove body that includes a hand opening, a backing, a palm and finger spaces. Attached to the gripping glove are laces that are capable of being tied together so the glove body can be tied to an object to be gripped. Also, loops are attached to the glove body that are capable of receiving a user's fingertips which allow the user to grip the object. Further included with the gripping glove is a detachable sleeve that allows the user to grip alternative types of objects. The combination of the laces, loops and detachable sleeve allows the user to grip several different types of objects.

8 Claims, 7 Drawing Sheets

GRIPPING GLOVE

TECHNICAL FIELD

The present invention relates generally to hand gloves, and in particular, gloves that aid in gripping an object.

BACKGROUND OF THE INVENTION

The gripping of objects could be considered an important aspect of everyday life because of the simple fact that people use their hands to grip objects all of the time during the course of the day. Yet, victims of many medical conditions, such as strokes, Parkinson's disease and multiple sclerosis, are unable to use their hands to grip objects with the fullest ability. In addition to sufferers of these and other diseases, many people lose the use of their hands as a result of a variety of hand trauma accidents. Losing the use of one's hand not only affects a person's ability to function with completing everyday tasks, the inability to use one's hand reduces the strength of the muscles in the hand itself, as well as any muscle (e.g. pectoral muscle) that traditionally requires the hand to aid in strengthening that particular muscle. Extensive hours of physical therapy are usually required for a person to recover the use of one's hand to the point where the person is able to function at a level that is similar to the level before the accident or onset of the medical condition. Many times this physical therapy requires the use of expensive special training equipment and a physical therapist present at all times. Large remedial equipment is not always practical for a person and sometimes the equipment is limited in its scope of recovering the use of a user's hand. The ability to use ordinary weight lifting equipment would allow a person to regain muscle ability without using special equipment. Furthermore, a piece of equipment that is versatile in its ability to allow the user to grip many different type of objects or weight equipment would be helpful for a person to regain the motor function of his or her hand. Also, the dependence of a person on a physical therapist can be redundant when the person possesses the knowledge of what must be accomplished, but needs a therapist present to work a machine. A piece of equipment that allows for maximum independence for a person would allow a physical therapist or trainer to focus on form, technique, alignment and specific training as opposed to focusing on the user gripping of the weight.

The present invention is directed to overcoming one or more of the problems set forth above.

SUMMARY OF THE INVENTION

In one aspect of the present invention, a glove comprises a glove body that includes a hand opening, a backing, a palm, finger spaces. Also the glove body includes means, including a plurality of laces attached to the glove body, for tying the glove body to an object to be gripped.

In another aspect of the present invention, a glove comprises a glove body that includes a hand opening, a backing, a palm, finger spaces and a plurality of elastic loops attached to the glove. The elastic loops being sized and positioned to receive a fingertip.

Another aspect of the present invention covers a method of gripping using a glove. The method includes securing a user's hand inside the glove, wrapping a user's hand around an object to be gripped and attaching the glove to the object to be gripped. This is accomplished by tying laces attached to the glove to one another and/or placing a user's fingertip in elastic loops attached to the glove.

DETAILED DESCRIPTION

Figures 1A, 1B:
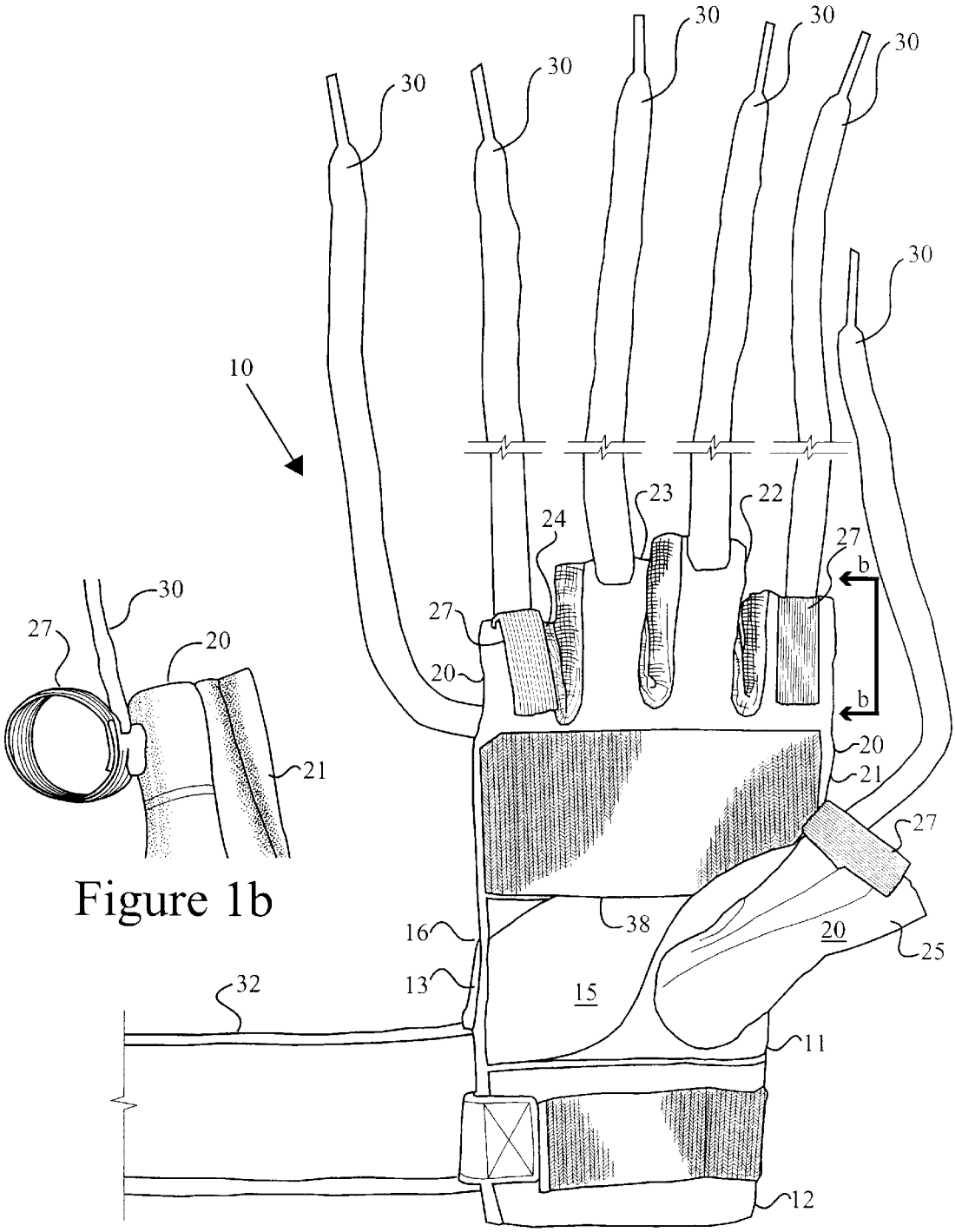
FIG. 1*a* is a palm view of the gripping glove according to the present invention.
FIG. 1*b* is an enlarged side-view along line b—b of the index finger space of the gripping glove shown in FIG. 1*a*.
Figure 2:
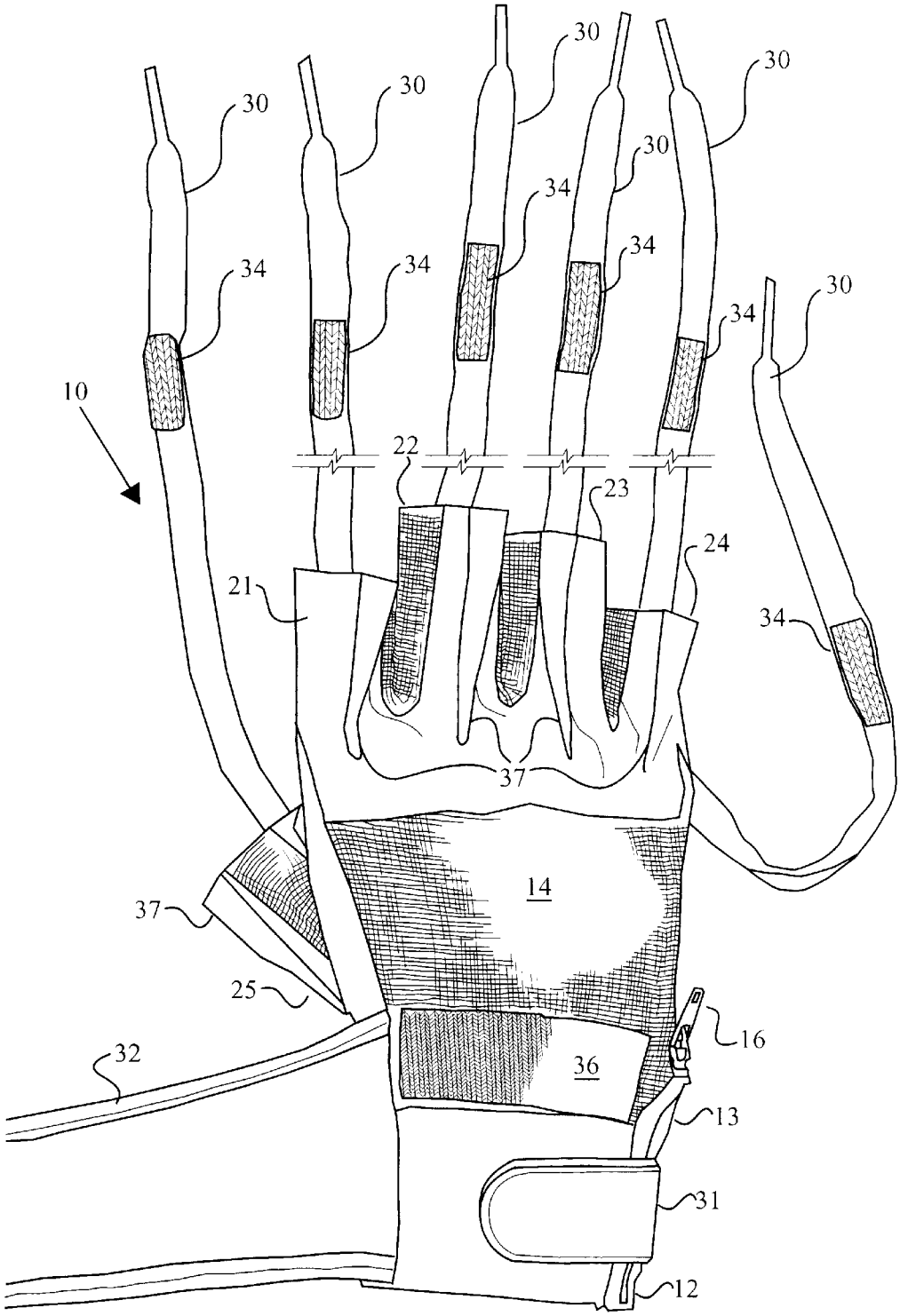
FIG. 2 is a back view of the gripping glove according to the present invention.

Referring now to FIGS. 1 and 2, a gripping glove 10 is shown with a glove body 11 that includes a hand entry opening 12, a backing 14, a palm 15 and five finger spaces 20. Hand entry opening 12 further consists of a seam opening 13 which is at least partially defined by zipper 16. Seam opening 13 and associated zipper 16 allows for easy access for a user in placing one's hand inside glove body 11. It can be appreciated that an alternative means for accessing the inside glove body 11 could be used such as a hook and loop fastening system defining seam opening 13. To ensure that a user's hand is secured inside glove body 11, a primary fastener 31 is included such that the hand entry opening 12 is fully closed and secured on the user's wrist. Glove body 11 also includes a wrist support strap 32 that preferably wraps around a user's wrist a least 360 degrees. Preferably the wrist support strap 32 utilizes a hook and loop fastening system but in can be appreciated that an alternative means could be used. Wrist support strap 32 offers support for the user's wrist as well as increased stability. The improved stability in turn, allows greater efficiency of movement for the user.

Glove body 11 includes five finger spaces 20 identified as the index finger space 21, middle finger space 22, ring finger space 23, little finger space 24 and thumb finger space 25. Preferably each finger space 20 does not fully cover a user's fingertip, instead the user's fingertip is exposed when the gripping glove 10 is covering the user's hand. It can be appreciated that it would still fall within the scope of the present invention if finger spaces 20 were to completely cover a user's fingertip. Preferably each finger space 20 includes a lace 30 attached near the open end of the finger space 20. Furthermore, preferably little finger space 24 contains an additional lace 30 also attached near the open end of little finger space 24. It can be appreciated that attaching laces 30 near the end of finger spaces 20 allows the maximum pulling force to be applied by laces 30 on the fingers of the user. This pulling force will aid in curling a user's finger around an object, therefore, producing a tighter grip around the object or weight machine bar. Laces 30 have been identified in the present invention, but it can be appreciated that laces 30 could be replaced with any suitable device that is capable of being attached to glove body 11 such as strings.

Index finger space 21, little finger space 24 and thumb finger space 25 include loops 27 attached to the palm 15 side of the glove body 11. Preferably, loops 27 are oriented nearly parallel to little finger space 24 and index finger space 21. Furthermore, loop 27 is oriented nearly perpendicular to thumb finger space 25. This orientation allows for the thumb finger of the user to easily be positioned in either loop 27 of the index finger space 21 or the little finger space 24. Likewise, this orientation allows for any of the other fingertips to be easily positioned in loop 27 of the thumb finger space 24. It can be appreciated that loops 27 are made of an elastic material such that a user's fingertip is easily positioned in a loop 27 during the gripping of several different sizes of objects.

Glove body 11 also includes fins 37 located on backside of finger spaces 20. These external fins 37 are shown to be fabric extensions of the finger spaces and are raised above the fabric of finger spaces 20 a certain length such that fins 37 could be grabbed by a user's fingers or teeth. It can be appreciated that fins 37 are attached to glove body 11 in a manner that allows a user to pull against the glove body 11, allowing a user to easily put on or remove the gripping glove 10.

Figure 3:
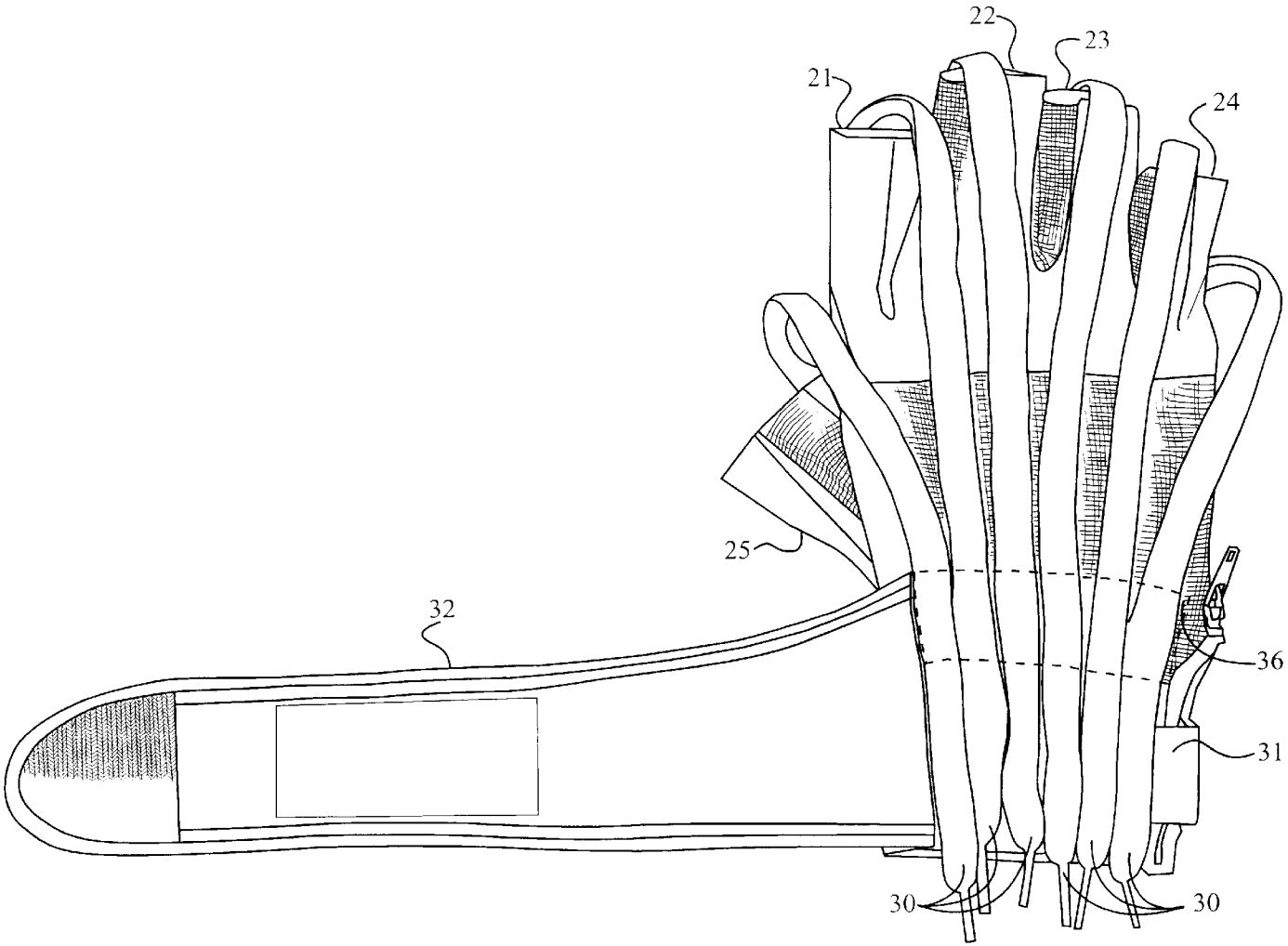
FIG. 3 is a back view of the gripping glove with the attached laces shown in their stowed position.

Referring additionally now to FIG. 3, laces 30 each have attached adjacent its loose end a hook patch 34 which is the hook half of a hook and loop fastening system. The other half of the hook and loop fastening system, loop patch 36, is located on backing 14 of glove body 11. When laces 30 are not being used in aiding the user to grip an object, laces 30 can be stowed to the backing 14 by attaching the hook patch 34 to the loop patch 36. Stowing of the laces 30 allows for gripping glove 10 to be used without laces 30 being a hindrance during its gripping uses that do not require the use of laces 30. It has been shown in FIG. 3 that all laces 30 attached to finger spaces 20 are stowed, but it can be appreciated that any combination of laces 30 could be stowed in the aforementioned manner without departing from the scope of the present invention.

Figure 4A:
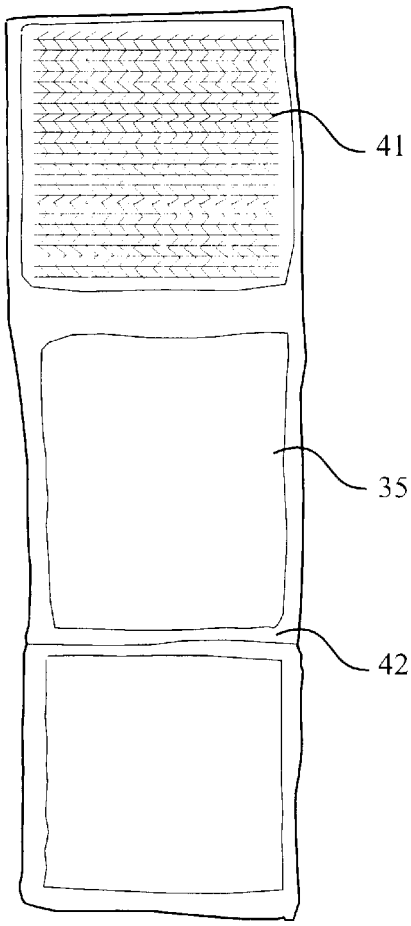
FIG. 4*a* is one view of the detachable sleeve according to the present invention.
Figure 4B:
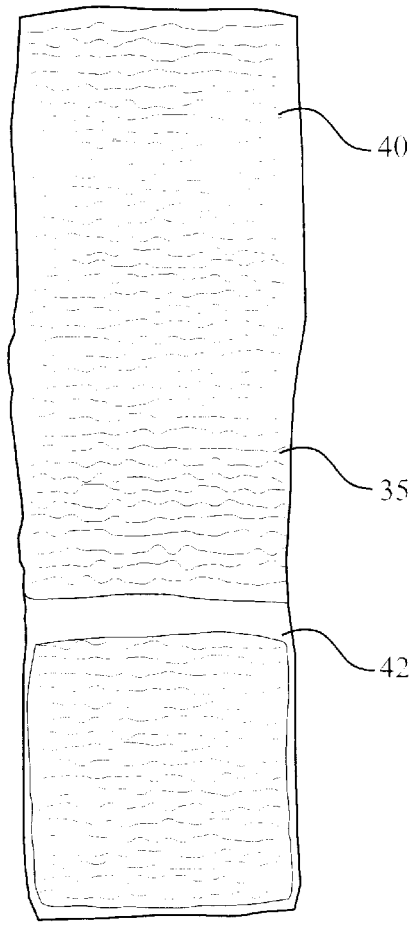
FIG. 4*b* is an opposite view of the detachable sleeve as shown in FIG. 4*a*.
Figure 4C:
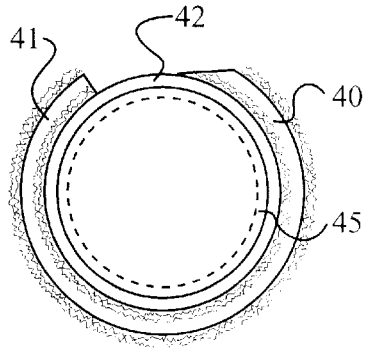
FIG. 4*c* is yet another view of the detachable sleeve as shown in FIG. 4*a*.

Referring additionally now to FIG. 4*a–c* where strip 35 is shown in detail. As shown in FIG. 1*a*, palm 15 of glove body 11 is shown to include means for attaching a strip 35 to palm 15. Preferably, such means is accomplished by a hook and loop fastening system with palm 15 having a loop region 38. Strip 35 is shown in FIGS. 4*a–c* with FIG. 4*a* showing one side of strip 35 and FIG. 4*b* showing the opposite side of strip 35. The side in FIG. 4*a* is shown to have a strip loop region 41 and FIG. 4*b* is shown to have a strip hook region 40. When strip 35 is formed around an object, strip loop region 41 and strip hook region 40 come in contact to form a releasable sleeve around the object 45 to be gripped. The advantage of the hook and loop fastening system on strip 35 is that the constructed sleeve is able to be attached and removed from object 45 quickly and without much effort from the user. Preferably, strip 35 also contains an elastic portion 42 such that strip 35 can be stretched tightly around an object 45 to be gripped 45. Furthermore, strip 35 is preferably formed around the object to gripped such that strip hook region 40 is on the outside of the sleeve. This arrangement allows for strip 35 to be attached to the palm loop region 38 such that the gripping glove 10, and consequently the user's hand, will be attached via the hook and loop fastening system to the object 45 to be gripped.

Figure 7:
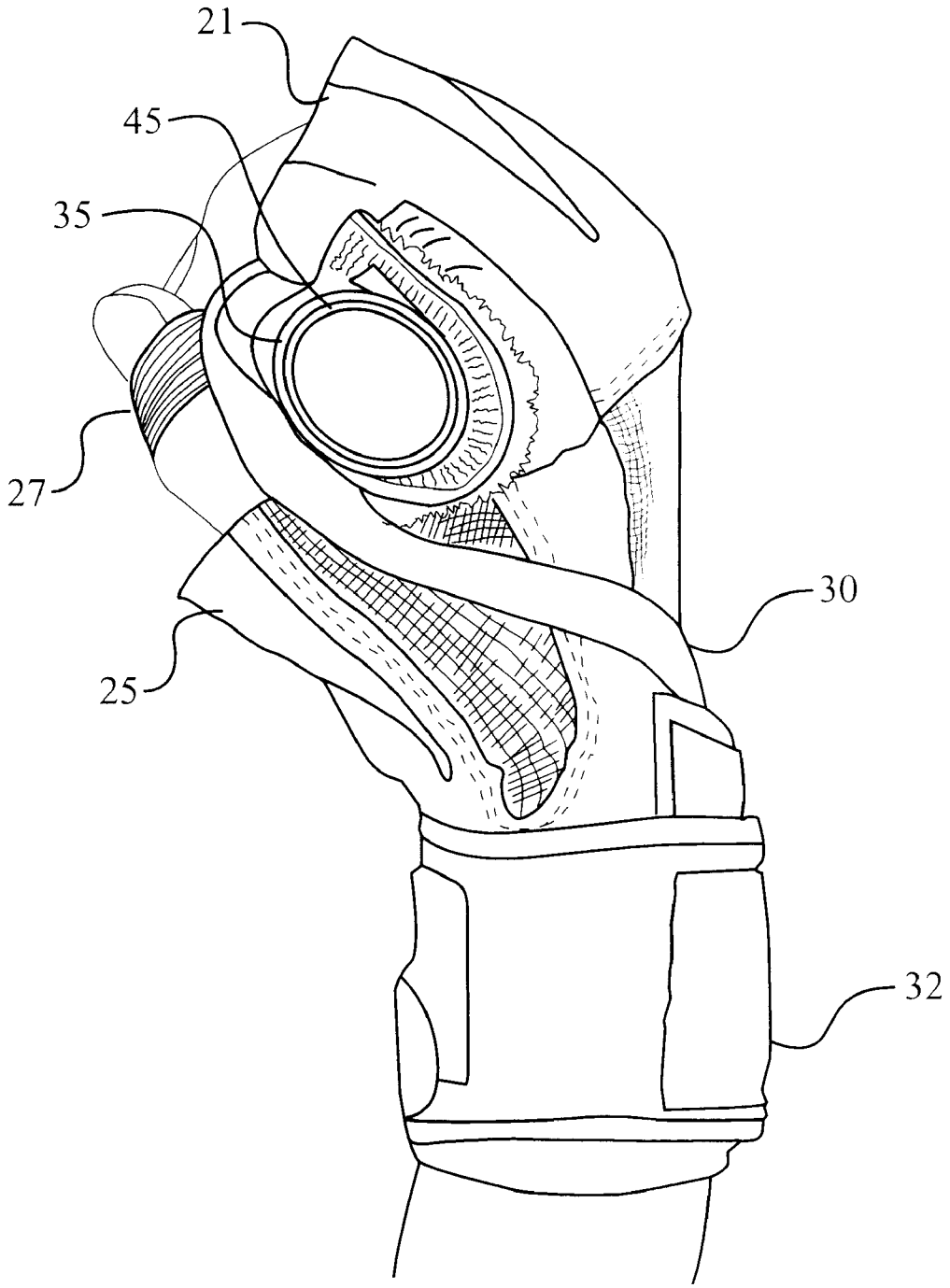
FIG. 7 is a side view of the gripping glove where an index finger loop is shown to aid in gripping an object.

Referring additionally now to FIG. 7, object 45 is show being gripped by gripping glove 10 using loop 27 and strip 35. Strip 35 is wrapped around object 45, and the loop region 38 (FIG. 1*a*) of glove 10 is fastened to the outer surface of strip 35 as previously described. In this particular arrangement, object 45 is gripped by the user wrapping the hand around strip 35 and object 45 and inserting user's thumb in one of the loop 27 on the index finger space 21. Although not shown in FIG. 7, it can be appreciated that user's thumb could be inserted in the alternative loop located on little finger space 24. Furthermore, any of the other user's fingertips could be placed in the loop located on the thumb finger space 25 (shown in FIG. 1*a*). Depending on the application, the user has the choice of which configuration presents the best form to grip object 45.

Figure 6:
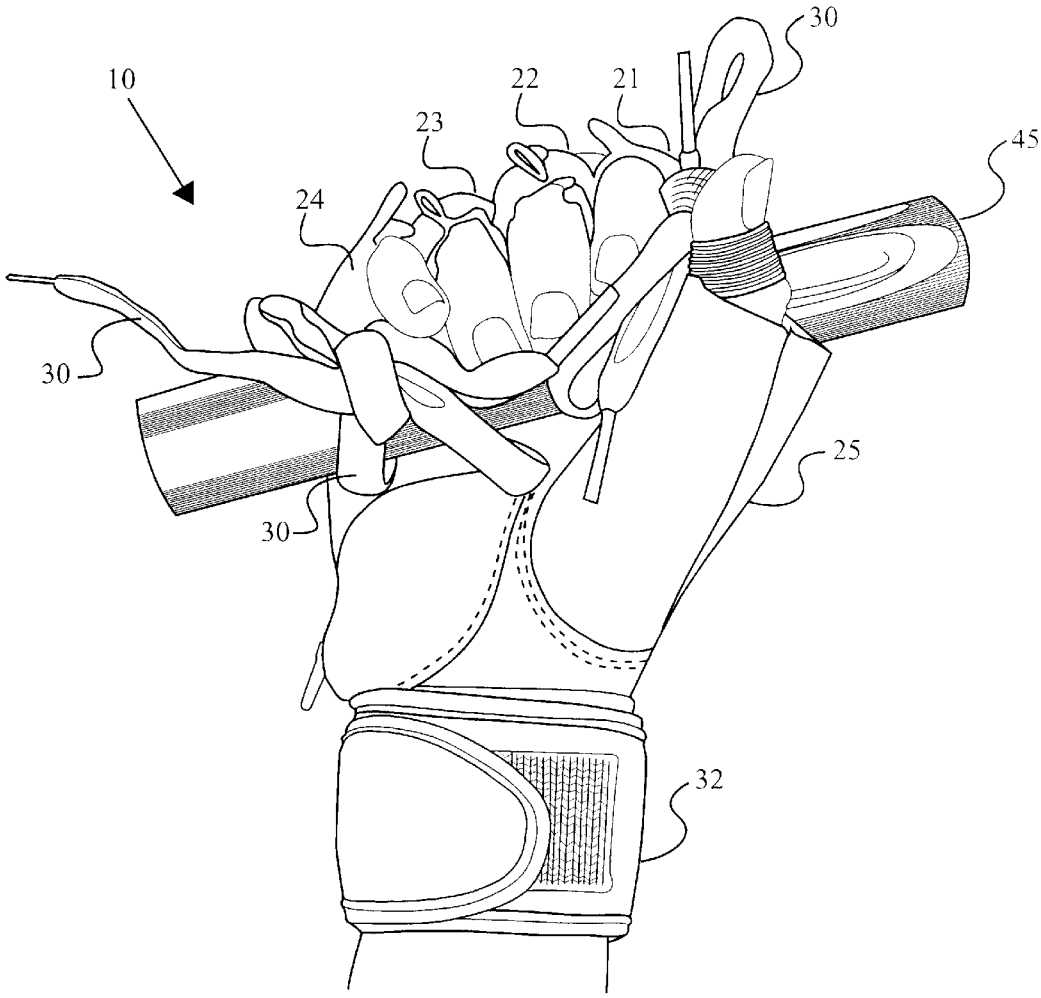
FIG. 6 is palm view of the gripping glove where laces are shown tying the glove around the object to be gripped.

Referring now to FIG. 6, object 45 can be gripped by a user wrapping one's hand around object 45 and tying the two laces 30 on little finger space 24 together and the laces on index finger space 21 and thumb finger space 25 together. The pulling of these respective laces 30 not only aid in curling the user's fingers around object 45, but the tying of laces 30 ensure that the user's hand will continue to grip object 45. Since laces 30 on middle finger 22 and ring finger 23 are not being used to grip object 45, those laces 30 are shown to be in their stowed configuration. It can be appreciated that while FIG. 6 shows a particular tying arrangement, any possible combination of tying of laces 30 could be used by the user depending on the desired configuration and the particular object 45 to be gripped.

Referring additionally now to FIG. 7, object 45 is show being gripped by gripping glove 10 using loop 27. In this particular arrangement, object 45 is gripped by the user wrapping the hand around object 45 and inserting user's thumb in one of the loop 27 on the index finger space 21. Although not shown in FIG. 7, it can be appreciated that user's thumb could be inserted in the alternative loop located on little finger space 24. Furthermore, any of the other user's fingertips could be placed in the loop located on the thumb finger space 25 (shown in FIG. 1*a*). Depending on the application, the user has the choice of which configuration presents the best form to grip object 45.

Figure 5:
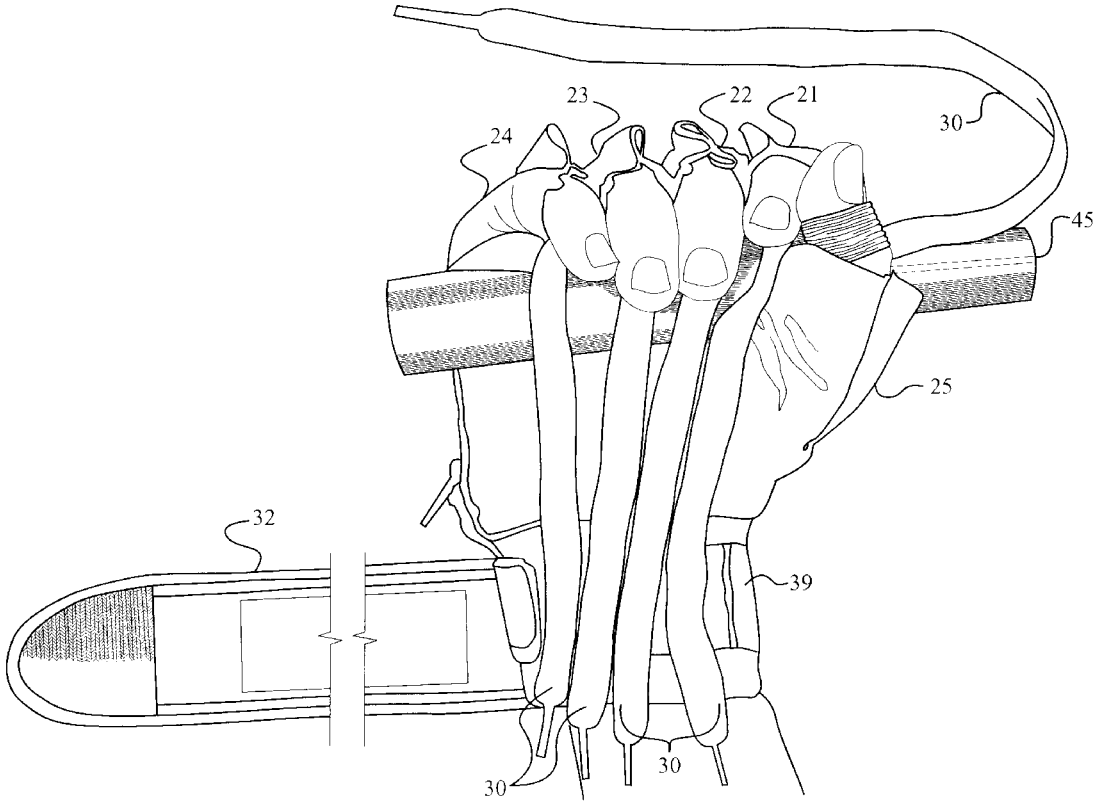
FIG. 5 is palm view of the gripping glove where laces are shown attaching the glove to an object to be gripped.

It can be appreciated that the gripping techniques shown in FIGS. 5–7 can be combined in many different combinations. For example, laces 30 on middle finger space 22 and ring finger space 23 could be wrapped around object 45 (as shown in FIG. 5) while laces 30 attached to little finger space 24 could be tied together around object 45 (as shown in FIG. 6). As another example, instead of laces 30 on little finger space 24 being tied together, the user's thumb fingertip could be inserted into loop 27 on little finger space 24 (as shown in FIG. 7). At the same time, laces 30 on middle finger space 22 and ring finger space 23 could be wrapped around object 45 (as shown in FIG. 5). Yet another example has the user using strip 35 (as shown in FIG. 4) in conjunction with tying the two laces 30 on little finger space 24 together and the laces on index finger space 21 and thumb finger space 25 together. The distinct advantage of the present invention is that the means for attaching the gripping glove 10 to an object 45 to be gripped can be used in many different ways. The type of equipment, the type of exercise, among other factors contribute to the user deciding which means for attaching the gripping glove 10 is the most useful for a particular application.

The present invention includes an embodiment for a method of gripping using a glove involving a first step of securing a user's hand inside the gripping glove 10. This step of securing is accomplished by placing the user's hand inside the gripping glove 10 at least in part by unzipping zipper 16. Furthermore, the user wraps a wrist strap 32 around the user's wrist at least 360 degrees. Also, the securing step includes the step of pulling against fins 37. The next step is wrapping the user's hand around an object 45 to be gripped. Finally, attaching the gripping glove 10 to the object 45 by at least in part by tying laces 30 to one another and/or placing user's fingertip in loops 27 attached to the gripping glove 10.

The above description is for illustrative purposes only, and is not intended to limit the scope of the invention in any way. Those skilled in the art will appreciate that a wide variety of modifications could be made to the illustrated gripping glove without departing from the intended scope of the invention, which is defined by the claims set forth below.

What is claimed is:

1. A glove comprising:

a glove body including a hand entry opening, a backing, a palm and finger spaces;

means, including a plurality of laces attached to said glove body, for tying said glove body to an object to be gripped;

said plurality of laces are attached to said finger spaces, and include a means for securing a loose end of said laces to said backing of said glove body; and said plurality of laces includes at least a lace attached to an index finger space, a lace attached to a thumb finger space and two laces attached to a little finger space.

2. A glove comprising:

a glove body including a hand entry opening, a backing, a palm and finger spaces;

means, including a plurality of laces attached to said glove body, for tying said glove body to an object to be gripped;

said glove includes a detachable sleeve;

means for attaching said sleeve to said palm;

said sleeve being formed by releaseably joining one end of a strip to an opposite end of said strip; and a portion of said strip being elastic.

3. A glove comprising:

a glove body including a hand entry opening, a backing, a palm and finger spaces;

means, including a plurality of laces attached to said glove body, for tying said glove body to an object to be gripped;

said finger spaces include a plurality of attached elastic loops;

said plurality of attached elastic loops includes a loop attached to an index finger space, a loop attached to a little finger space and a loop attached to a thumb finger space;

said loops being sized for receiving a fingertip.

4. A glove comprising:

a glove body including a hand entry opening, a backing, a palm and finger spaces;

a plurality of elastic loops attached to said glove;

said loops being sized and positioned to receive a fingertip; and said plurality of elastic loops includes a loop attached to an index finger space, a loop attached to a little finger space and a loop attached to a thumb finger space.

5. A glove comprising:

a glove body including a hand entry opening, a backing, a palm and finger spaces;

a plurality of elastic loops attached to said glove;

said loops being sized and positioned to receive a fingertip;

said glove includes a detachable sleeve;

means for attaching said sleeve to said palm;

said sleeve being formed by releaseably joining one end of a strip to an opposite end of said strip; and a portion of said strip being elastic.

6. A glove comprising:

a glove body including a hand entry opening, a backing, a palm and finger spaces;

a plurality of elastic loops attached to said glove;

said loops being sized and positioned to receive a fingertip;

a plurality of laces are attached to said finger spaces, and include a means for securing a loose end of said laces to said backing of said glove body; and said plurality of laces includes at least a lace attached to an index finger space, a lace attached to a thumb finger space and two laces attached to a little finger space.

7. A method of gripping using a glove, comprising the steps of:

securing a user's hand inside said glove;

wrapping said user's hand around an object to be gripped;

attaching said glove to said object to be gripped at least in part by at least one of, tying laces attached to said glove to one another and placing a user's fingertip in an elastic loop attached to said glove; and said attaching step includes the steps of tying an index finger space lace to a thumb finger space lace, and tying a little finger space lace to another little finger space lace.

8. A method of gripping using a glove, comprising the steps of:

securing a user's hand inside said glove;

wrapping said user's hand around an object to be gripped;

attaching said glove to said object to be gripped at least in part by at least one of, tying laces attached to said glove to one another and placing a user's fingertip in an elastic loop attached to said glove;

said attaching step includes the steps of forming a sleeve around an object to be gripped by joining one end of a strip to an opposite end of said strip; and attaching said sleeve to said glove.

* * * * *